US006498340B2

(12) United States Patent
Anderson et al.

(10) Patent No.: US 6,498,340 B2
(45) Date of Patent: Dec. 24, 2002

(54) METHOD FOR CALIBRATING MASS SPECTROMETERS

(75) Inventors: Gordon A. Anderson, Benton City, WA (US); Michael D. Brands, Richland, WA (US); James E. Bruce, Schwenksville, PA (US); Ljiljana Pasa-Tolic, Richland, WA (US); Richard D. Smith, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 09/760,248

(22) Filed: Jan. 12, 2001

(65) Prior Publication Data

US 2002/0130259 A1 Sep. 19, 2002

(51) Int. Cl.[7] ..... H01J 49/00
(52) U.S. Cl. ..... 250/252.1; 250/282
(58) Field of Search ..... 250/282, 252.1

(56) References Cited

U.S. PATENT DOCUMENTS 4,500,782 A * 2/1985 Allemann et al. ..... 250/291
5,300,771 A * 4/1994 Labowsky ..... 250/282

* cited by examiner

*Primary Examiner*—Kiet T. Nguyen
(74) *Attorney, Agent, or Firm*—Stephen R. May; Douglas E. McKinley, Jr.

(57) ABSTRACT

A method whereby a mass spectra generated by a mass spectrometer is calibrated by shifting the parameters used by the spectrometer to assign masses to the spectra in a manner which reconciles the signal of ions within the spectra having equal mass but differing charge states, or by reconciling ions having known differences in mass to relative values consistent with those known differences. In this manner, the mass spectrometer is calibrated without the need for standards while allowing the generation of a highly accurate mass spectra by the instrument.

6 Claims, 3 Drawing Sheets

METHOD FOR CALIBRATING MASS SPECTROMETERS

STATEMENT REGARDING FEDERALLY SPONSORED RESEARCH OR DEVELOPMENT

This invention was made with Government support under Contract DE-AC06-76RLO 1830 awarded by the U.S. Department of Energy. The Government has certain rights in the invention.

CROSS REFERENCE TO RELATED APPLICATIONS

Not Applicable

FIELD OF THE INVENTION

The present invention relates generally to a method for improving the calibration of a mass spectrometer. More specifically, the invention is a method whereby a mass spectra generated by a mass spectrometer is calibrated by shifting the parameters used by the spectrometer to assign masses to the spectra in a manner which reconciles the signal of ions within the spectra having equal mass but differing charge states, or by reconciling ions having known differences in mass to relative values consistent with those known differences. In this manner, the present invention allows calibration of the mass spectrometer without the need for standards while allowing the generation of a highly accurate mass spectra by the instrument.

BACKGROUND OF THE INVENTION

The ability of mass spectrometry to rapidly sort through complex biological mixtures and identify the component proteins, peptides, oligonucleo-tides, and noncovalent complexes is rapidly being adopted in biological research, especially for proteome characterization and protein profiling. There is a well recognized need for the high throughput identification of these and other species, for example proteins and their posttranslational modifications that are, for example, up-regulated or down-regulated in response to a specific external stimulus, the onset of disease, or normal aging. The conventional approach to proteomics involves the high resolution separation of proteins using 2D polyacryl-amide gel electrophoresis followed by their one-at-a-time excision and characterization, increasingly exploiting mass spectrometry. Additional information is generally gathered in the form of a correlation between the peptide masses for peptide fingerprinting (e.g., their common origin from a single protein), or by partial peptide sequencing. However, even complete automation of separations and sample processing imposes practical limitations upon the throughput of these methods.

The use of higher mass accuracy mass measurements has the potential to greatly speed proteome characterization and protein identification. Sufficiently high mass measurement accuracy, in principal, can enable the identification of a protein from a single peptide mass. Thus, a complex protein mixture can be enzymatically digested and the resulting peptide mixture separated and used for protein profiling and posttranslational modification determination. Yates and co-workers have pioneered an approach based upon capillary liquid chromatography tandem mass spectrometry (LC-MS/MS) of enzymatically digested protein mixtures in McCormack, A. L.; Schieltz, D. M.; Goode, B.; Yang, S.; Barnes, G.; Drubin, D.; Yates, J. R. *Anal. Chem.* 1997, 69, 767–776, the entire contents of which is incorporated herein by this reference.

Processing of more complex mixtures for ever higher throughput analyses, such as the analysis of whole proteomes, results in much greater demands on mass spectrometry, in terms of speed, resolution, mass measurement accuracy, and data-dependent acquisition. As such, calibration schemes that can enable higher mass accuracy measurements to be accomplished over a wide range of conditions play an essential role in the successful application of mass spectrometry to protein identification from complex peptide mixtures. Experiments involving on-line chromatographic or electrophoretic separations also present the additional constraint that mass calibration functions, for example, in Fourier transform ion cyclotron resonance (FTICR), can change from spectrum to spectrum for reasons related to variations in the size of the trapped ion population. For example, Easterling et al. recently demonstrated that the detected cyclotron frequency (and the derived mass measurement) in FTICR experiments could change over a range of 110 ppm for MALDI mass spectra of the peptide bradykinin de-pending upon trapped ion population size in Easterling, M. L.; Mize, T. H.; Amster, I. J. *Anal. Chem.* 1999, 71, 624–632, the entire contents of which are incorporated herein by this reference. Clearly, such a level of mass measurement uncertainty greatly limits protein characterization efforts and generally precludes the use of mass measurements for single peptide species for protein identification (i.e., to serve as a "biomarker" for a specific protein). Importantly, Easterling et al. also showed that this frequency shift, at least to the very low ppm level is linearly related to the number of trapped ions and thus, can be effectively corrected when the ion population size is known or reproducibly controlled. This observed effect of ion population is also consistent with the understanding of the effects of space charge upon ion cyclotron motion in FTICR. In Burton, R. D.; Matuszak, K. P.; Watson, C. H.; Eyler, J. R. *J. Am. Soc. Mass Spectrom.* 1999, 10, 1291–1297, the entire contents of which are incorporated herein by this reference, Burton et al. showed that measurements based upon "external calibration" and a single "internal" standard could provide mass accuracies essentially equivalent to those obtained with multiple internal calibrants, and an order of magnitude greater accuracy than external calibration alone. These results are also consistent with the conclusion of Easterling et al., showing that variations in trapped ion population sizes lead to essentially constant ion cyclotron frequency shifts or offsets across the mass spectrum.

Space-charge effects on mass calibration are manifested by stepwise shifts, or offsets, of all frequencies to an extent that depends upon ion population size, a quantity that is generally unknown or not well defined in most experiments. Thus, the requirement for prior knowledge of the sample, the trapped ion population, or the conditions under which the measurements were made, presents a drawback for this technique, and there is still a general need for improved methods for calibrating a mass spectometer without the use of calibrants and where the ion population size is unknown.

SUMMARY OF THE INVENTION

The present invention exploits information that is derived from the mass differences for different charge states of the same molecular species that are generally present in a mass spectra where molecules of differing charge states but identical mass are present, such as those formed in electro-spray ionization mass spectra. The operation of the present invention is described herein in the context of addressing space-charge effects on mass calibration for Fourier Transform Ion Cyclotron Resonance (FTICR) mass spectrometry, but as will be apparent to those having skill in the art, the present invention is equally applicable to other types of instruments as well, because similar offsets in time-of-flight, sector mass spectrometers, or quadrupole ion trap data, for example, can readily be assessed using the method of the present invention. The use of the present invention with such instruments should therefore be understood to be within the scope of the present invention. The method of the present invention is also applicable in cases where ions having predictable mass differences occur, such as the case with adducts, and the present invention should be understood to include such cases.

The present invention determines the frequency shift in a way that does not require any prior knowledge of the sample, trapped ion population, or the conditions under which the measurements were made. In fact, with larger numbers of charge states, possible higher-order nonlinear frequency shifts (frequency shifts that vary across the frequency or m/z spectrum) should also be amenable to deconvolution, because subsequent pairs of charge states across the envelope could be used to effectively define the frequency shift as a function of frequency. However, the present invention described herein shows that first order, linear effects of space charge, can be corrected to provide improved mass measurement accuracy.

The present invention makes use of the fact that mass resolution sufficient to resolve isotopic peaks in electrospray source ionization (ESI) FTICR and other mass spectrometers allows definitive charge state assignment. In cases where multiple charge states are observed, as is common with electro-spray ionization, a relationship exists between the m/z of each isotopic peak for each charge state of a given species. For positively charged species resulting from protonation or other cation attachment, this relationship is defined by $$(m/z)_n = \frac{M + n(M_c)}{n} = \frac{kB}{fn}$$

where $(m/z)_n$ is the observed mass to charge ratio of a given peak in the isotopic envelope, n is the number of charges, M is the molecular weight, and $M_c$ is the mass of the charge carrier, k is a proportionality constant relating m/z to the magnetic field (B) and the cyclotron frequency (fn). The first order linear shift of the observed cyclotron frequencies due to space-charge effects results in m/z values for each of the peaks being shifted from their "true" position. In addition, because of the constant frequency shift and the relationship between m/z and frequency, the relationship between charge states is also affected and is observed in the "deconvoluted" mass spectrum. For example, solving the above equation for M in terms of cyclotron frequency gives $$M = n\frac{kB}{fn} - n(M_c)$$

From this equation, it is clear that if all cyclotron frequencies fn are shifted by some offset Df due to space-charge effects, the observed perturbation on the deconvoluted mass, M, is charge state dependent since the quantity kB/(f1 Df) is multiplied by the charge state in the above equation. Thus, Df can be derived from the mass domain by the iterative addition or subtraction of incremental frequency shifts prior to deconvolution. The minimum error is obtained when the observed mass differences produced for different charge states are eliminated; i.e., when the optimal frequency offset due to space-charge effects has been determined.

Thus, the present invention is a method for improving the calibration of a mass spectrometer having calibration parameters by first measuring the mass to charge signal generated by ions within the mass spectrometer using the calibration parameters, then identifying a plurality of ions of equal mass having differing charge states, then adjusting the calibration parameters to cause the plurality of ions of equal mass having differing charge states to be shifted to show the same mass, and finally adjusting the measured mass to charge signal generated by the ions within the mass spectrometer utilizing the adjusted calibration parameters. In this manner, a spectrum of the ions having improved calibration may be determined. In cases where ions are present which have predictable mass differences, such as with known adducts, the present invention proceeds in an analogous manner by first measuring the mass to charge signal generated by ions within the mass spectrometer using the calibration parameters, then identifying a plurality of ions having known mass differences having differing charge states; then adjusting the calibration parameters to cause the plurality of ions having differing masses to be shifted to a relative position corresponding to the known differences in their mass, and finally adjusting the measured mass to charge signal generated by the ions within the mass spectrometer utilizing the adjusted calibration parameters.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

A preferred embodiment of the present invention has been initially implemented by mass transformation of the m/z spectrum followed by conversion into a table of neutral masses (using the ICR-2LS software developed with Department of Energy funding at the Pacific Northwest National Laboratory (Richland, Wash.) which is available to the public). The algorithm employed for mass transformation is based on the program thrash developed by Horn et al. and described in Horn, D. M.; Zubarev, R. A.; McLafferty, F. W. *J Am. Soc. Mass Spectrom.* 2000, 11, 320–332, the entire contents of which are incorporated herein by this reference.

Figure 1:
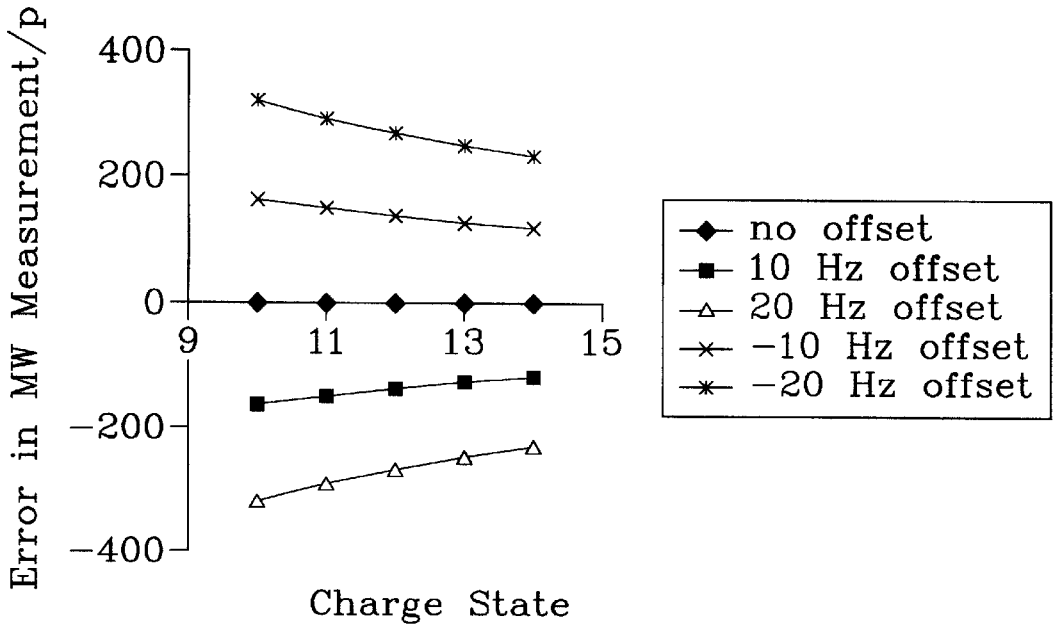
FIG. 1 shows the calculated effects on mass determination from several charge states for several cyclotron frequency offsets. Under conditions with zero frequency offset, all charge states yield the correct mass, and increasing the frequency shift results in increased mass measurement errors. For a given nonzero frequency offset, the resulting mass measurement errors increase with decreasing charge states.

The results of this mass transformation are saved in data structures to be corrected by the present invention after all charge state distributions in the spectrum are transformed. The deconvoluted masses are sorted in order of abundance and then masses resulting from charge state pairs are collected. Each charge state pair is then used to calculate a frequency shift that is used to correctly align the two deconvolved isotopic envelopes for the same molecular species. This calculation is repeated for each charge state pair. The final frequency shift to be applied to all data (for the case of a first order correction) is determined by calculating a weighted average of the frequency shifts measured for each charge state pair, where the abundance of each deconvolved isotope distribution provides a weighting factor. This weighting procedure is justified because more intense peaks are less susceptible to mass measurement error resulting from random noise compared to smaller peaks as described in Chen, L.; Cottrell, C. E.; Marshall, A. G. *Chemometric Intelligent Lab. Syst.* 1986, 1, 51–58, and Liang, Z.; Marshall, A. G. *Appl. Spectrosc.* 1990, 44, 766–775, the entire contents of each of which are incorporated herein by this reference, and, therefore, should produce a better measurement of the ion cyclotron frequency offset. This procedure determines an initial frequency shift; its value is then further optimized in this initial implementation as follows. The average charge state pair error is calculated using the initial frequency shift value and any charge state pair having an error greater than two times the average error is removed and the frequency shift is recalculated. The resulting "optimal" frequency is then used as the basis to recalculate all masses, and is reported along with the charge state pairs used and their respective errors. The effect of a cyclotron frequency offset on measured mass, as is encountered under conditions where the ion population is substantially different than that used for calibration, is illustrated in FIG. 1 with m/z values and cyclotron frequencies that one would calculate for myoglobin. The m/z values and cyclotron frequencies for the most abundant isotopic peaks for five charge states (ranging from 101 to 141) of horse myoglobin were calculated, and then used to calculate the molecular weight. The calculated cyclotron frequencies of these peaks were then all sequentially modified by 220, 210, 110, and 120 Hz and the masses based on each of the resulting peaks were then recalculated. All calculated masses were then compared to the theoretical mass for the most abundant isotopic peak and the observed error values were plotted in parts-per-million (ppm). Obviously, the analysis involving no frequency offset produced no error when compared to the theoretical mass, and larger frequency offsets resulted in larger observed errors. An important point, however, is that the offset data all produced sloped error curves, indicating that the constant frequency offset results in increasingly larger mass measurement errors with decreasing charge state. Therefore, poor agreement is observed between MW determinations based on successive charge states if the data are taken under space charge conditions that differ from those used for calibration.

Figure 2:
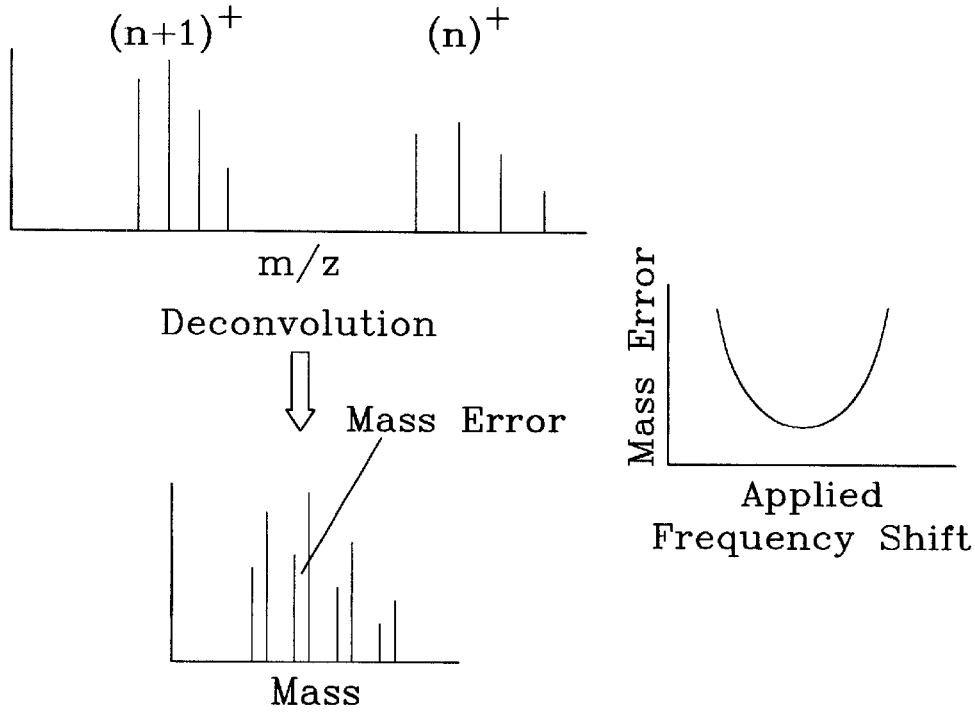
FIG. 2 is a schematic representation of the method of the present invention. Deconvolution of two or more charge states for the same species to the mass domain should result in a single isotopic distribution. However, a constant frequency offset of the data before deconvolution results in mismatch of the isotope distributions after deconvolution of each charge state. The method of the present invention iteratively shifts the cyclotron frequency spectrum and identifies a minimum in the observed mismatch or mass error for the deconvoluted spectrum.

In addition, iteratively shifting the frequency of the entire spectrum allows the contribution of the frequency offset due to space charge to be determined from the optimum overlap of deconvoluted isotopic envelopes. FIG. 2 illustrates the principle of this preferred embodiment of the present invention. The measured mass error is defined as the difference between deconvoluted isotope distributions, and the effect observed by adding a constant frequency offset before the mass deconvolution is illustrated (FIG. 2, right). As discussed above, a previously established calibration can result in relatively large mass measurement errors if trapped ion population sizes differ significantly, even if other external factors (e.g., magnetic field, excitation, and trapping conditions) are un-changed. In addition to large mass measurement errors that are observed, deconvolution of each of the detected charge states shows the differences in measured masses produced by each charge state. Again, the uncorrected masses are not only in error, but different charge states yield different masses. Thus, two differing isotopic distributions will generally result when each charge state is converted to the mass domain with deconvolution algorithms. A minimum in the mass measurement error is observed when the two (or several) charge states overlap exactly, i.e., when the optimal frequency shift correction is applied.

Figure 3A:
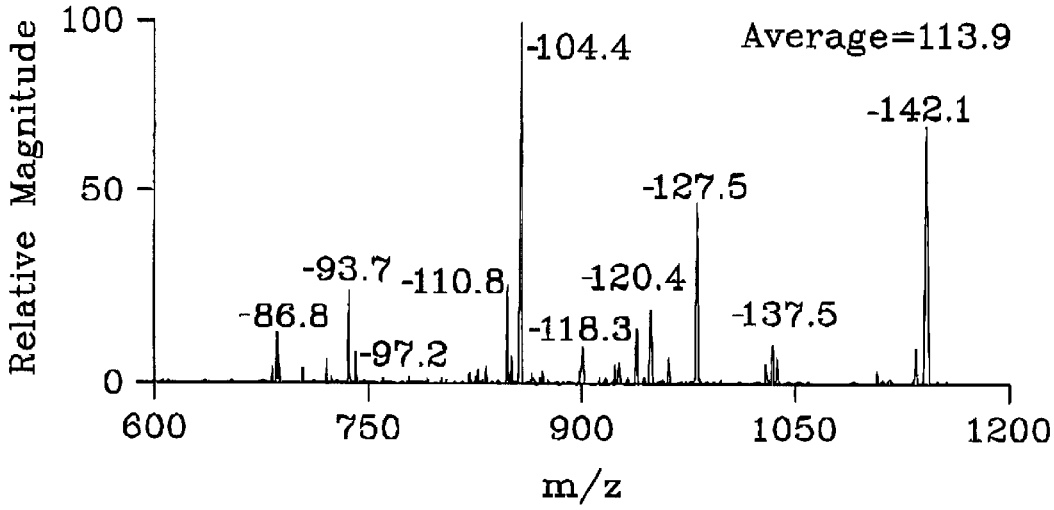
FIG. 3*a* is a specta obtained in an ESI-FTICR mass spectrum of a complex mixture of peptides resulting from tryptic digestion of bovine serum albumin. Because of the poor match between the ion population measured for this spectrum and that used to generate the external calibration, relatively large mass measurement errors are produced, with an average error of 113 ppm.
Figure 3B:
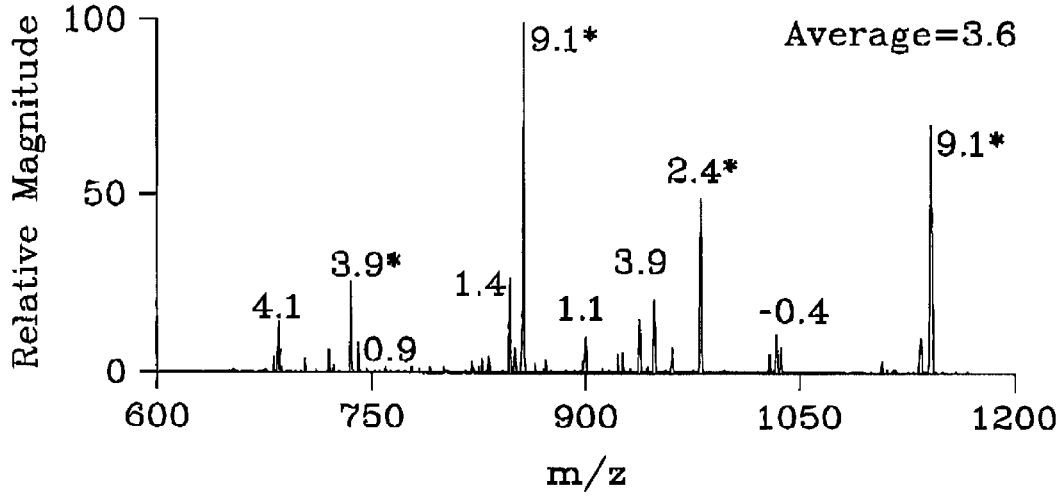
FIG. 3*b* is a demonstration of a preferred embodiment of the present invention using the same data as in FIG. 3*a* but with the method of the present invention implemented using the two pairs of charge states indicated with asterisks. This process improved the capability for identification and reduced average mass measurement error to 3.6 ppm.
Figure 4:
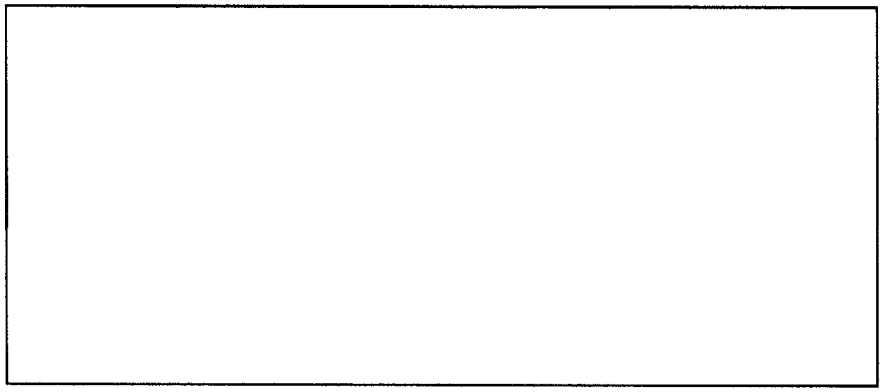
FIG. 4. is a schematic drawing representing all of the following: a fourier transform mass spectrometer, an ion cyclotron mass spectrometer, a quadrupole ion trap, a time of flight mass spectrometer, and a sector mass spectrometer.

The application of the preferred embodiment of the present invention to improve mass measurement accuracy for arbitrary trapped ion population sizes is shown in FIG. 3. The data were obtained from a tryptic digest of bovine serum albumin (BSA) with a 7 tesla FTICR mass spectrometer described Winger, B. E.; Hofstadler, S. A.; Bruce, J. E.; Udseth, H. R.; Smith, R. D. *J. Am. Soc. Mass Spectrom.* 1993, 4, 566–577, the entire contents of which are incorporated by this reference, and were chosen specifically for this example because the trapped ion population was significantly larger than that used for the prior calibration. This difference leads to relatively large mass measurement errors, and is a situation that often applies in real-world applications such as those involving on-line separations. Each peak was first deconvoluted and then searched against the set of possible BSA tryptic peptides, allowing many peaks to be assigned to specific peptides as described in Bruce, J. E.; Anderson, G. A.; Wen, J.; Harkewicz, R.; Smith, R. D. *Anal. Chem.* 1999, 71, 2595–2599, the entire contents of which are incorporated herein by this reference. The errors (shown in ppm) are the differences between the measured masses and those calculated based on the assigned peptide sequences. The average error using the prior "external" calibration was 113.9 ppm. The method of this preferred embodiment of the present invention was then performed on the data using the two pairs of charge states indicated in FIG. 3*b* with asterisks, and resulted in a reduced average error of 3.6 ppm. Importantly, this improvement was obtained without any information regarding the identity of these peaks or the use of internal calibration. The only requirement is that the initial calibration not be so poor that an automated relationship between two different charge states of the same molecular species cannot be established. In this case, the initial calibration was initially in error by 113 ppm and the approach we have implemented successfully established the correct charge state relationships within a complex spectrum. An extremely important area of application of this approach is in conjunction with on-line separations, where the use of internal calibrants can be problematic. Table 1 shows the results obtained using the same 7 tesla FTICR mass spectrometer with an on-line liquid chromatography separation of the peptide mixture from a tryptic digestion of BSA. One LC separation run was performed for these analyses and a comparison between three different calibration methods (both with and without use of this preferred embodiment of the present invention) is presented in Table 1. As mentioned above, results obtained using external calibration can be substantially less accurate due to large fluctuations in trapped ion population sizes and resulting space-charge effects. For example, in spite of the fact that the external calibration was obtained with 0.43 ppm mass measurement error, the LC data produced average mass measurement errors of 77 ppm (column 1). This is most likely due to the large variations in trapped ion population sizes that are to be expected during the course of on-line separations. For comparison, a calibration function was also created directly from one spectrum acquired during the separation that exhibited a total ion intensity fairly representative of the average observed throughout the separation. This calibration reduced the observed average mass measurement error, but only to 46 ppm (column 3). This level of performance represented the best mass measurement accuracy that could be achieved for these data under the present conditions, and in the absence of further correction.

However, the application of this preferred embodiment of the present invention to these data significantly reduced the average mass measurement error to 7 ppm. Again, this was done with the default calibration and utilized an average of four pairs of charge states in each spectrum. As an alternative approach, a calibration that included a total ion intensity term was generated with two of the spectra acquired during the separation, one representing the average ion abundance and another representing a low abundance. This intensity correction was determined by integrating the peak areas in the spectrum and using this area as a measure of the total ion intensity. Several different methods were investigated to calculate the total ion abundance, but all yielded very similar results. This intensity correction improved the observed mass measurement accuracy slightly, to 43.6 ppm. Again, the application of this preferred embodiment of the present invention to these data significantly reduced the average mass measurement error to 5.41 ppm.

TABLE 1

Average mass measurement errors from FTICR mass spectra obtained during an LC separation. Compared are the results from the standard, external mass calibration, that obtained from the internal calibration generated from one spectrum (363) taken during the separation, and an intensity calibration generated using two of the spectra obtained during the separation. Each of the calibration methods is then further corrected using the method of the present invention.

| Scan Number | External calibration | External calibration with the preferred embodiment of the present invention | Calibration generated using spectrum 363 | Calibration generated using spectrum 363 with The preferred embodiment of the present invention Intensity | Intensity calibration generated using spectra 302 and 363 Intensity | Intensity calibration generated using spectra 302 and 363 with The preferred embodiment of the present invention |
|---|---|---|---|---|---|---|
| 301 | 32.83 | 8.89 | 96.51 | | 31.41 | 7.32 |
| 310 | 43.14 | 2.31 | 73.45 | 5.66 | 7.08 | 5.32 |
| 320 | 62.27 | 6.62 | 67.45 | 8.89 | 55.46 | 7.46 |
| 330 | 83.44 | 10.36 | 34.9 | 7.81 | 45.55 | 6.45 |
| 340 | 76.2 | 5.15 | 35.14 | 6.41 | 38.89 | 3.24 |
| 350 | 94.67 | 9.49 | 32.17 | 6.62 | 32.3 | 6.32 |
| 360 | 100.93 | 12.11 | 16.87 | 10.66 | 21.6 | 7.67 |
| 370 | 90.81 | 3.54 | 12.73 | 5.74 | 26.15 | 4.91 |
| 380 | 94.27 | 7.55 | 23.12 | 9.69 | 56.84 | 2.61 |
| 390 | 94.18 | 5.35 | 47.92 | 4.15 | 83.48 | 3.7 |
| 400 | 70.78 | 6.57 | 68.19 | 4.38 | 80.89 | 4.53 |
| Avg. error | 76.68 | 7.09 | 46.22 | 7.00 | 43.60 | 5.41 |

We claim:

1. A method for improving the calibration of a mass spectrometer having calibration parameters comprising the steps of:

a) measuring the mass to charge signal generated by ions within the mass spectrometer using the calibration parameters, b) identifying a plurality of ions of equal mass having differing charge states;

c) adjusting the calibration parameters to cause the plurality of ions of equal mass having differing charge states to be shifted to show the same mass, and d) adjusting the measured mass to charge signal generated by the ions within the mass spectrometer utilizing the adjusted calibration parameters to generate a spectrum of the ions having improved calibration.

2. The method of claim 1 wherein the mass spectrometer is selected from the group consisting of fourier transform ion cyclotron resonance mass spectrometers, quadrupole ion traps, time of flight mass spectrometers, and sector mass spectrometers.

3. A method for improving the calibration of a fourier transform ion cyclotron resonance mass spectrometer having calibration parameters comprising the steps of:

a) measuring the mass to charge signal generated by ions within the mass spectrometer using the calibration parameters, b) identifying a plurality of ions of equal mass having differing charge states;

c) adjusting the calibration parameters to cause the plurality of ions of equal mass having differing charge states to be shifted to show the same mass, and d) adjusting the measured mass to charge signal generated by the ions within the mass spectrometer utilizing the adjusted calibration parameters to generate a spectrum of the ions having improved calibration.

4. A method for improving the calibration of a mass spectrometer having calibration parameters comprising the steps of:

a) measuring the mass to charge signal generated by ions within the mass spectrometer using the calibration parameters, b) identifying a plurality of ions having known mass differences having differing charge states;

c) adjusting the calibration parameters to cause the plurality of ions having known mass differences to be shifted to a relative position corresponding to the known differences in mass, and d) adjusting the measured mass to charge signal generated by the ions within the mass spectrometer utilizing the adjusted calibration parameters to generate a spectrum of the ions having improved calibration.

5. The method of claim 4 wherein the mass spectrometer is selected from the group consisting of fourier transform ion cyclotron resonance mass spectrometers, quadrupole ion traps, time of flight mass spectrometers, and sector mass spectrometers.

6. A method for improving the calibration of a fourier transform ion cyclotron resonance mass spectrometer having calibration parameters comprising the steps of:

a. measuring the mass to charge signal generated by ions within the mass spectrometer using the calibration parameters, b. identifying a plurality of ions having known mass differences having differing charge states;

c. adjusting the calibration parameters to cause the plurality of ions having known mass differences to be shifted to a relative position corresponding to the known differences in mass, and d. adjusting the measured mass to charge signal generated by the ions within the mass spectrometer utilizing the adjusted calibration parameters to generate a spectrum of the ions having improved calibration.

* * * * *